US005968398A

United States Patent [19]

Schmitt et al.

[11] Patent Number: 5,968,398

[45] Date of Patent: Oct. 19, 1999

[54] APPARATUS AND METHOD FOR NON-CONTACT DETECTION AND INDUCTIVE HEATING OF HEAT RETENTIVE FOOD SERVER WARMING PLATES

[75] Inventors: Philip Schmitt, Central Islip, N.Y.; Michael Blaze McDermott, Washington, Mo.

[73] Assignee: The Lepel Corporation, Edgewater, N.Y.

[21] Appl. No.: 08/859,829

[22] Filed: May 16, 1997

[51] Int. Cl.[6] ..... H05B 6/12

[52] U.S. Cl. ..... 219/626; 219/620

[58] Field of Search ..... 219/626, 624, 219/625, 627, 620, 650; 422/186.16; 363/98, 134; 372/38

[56] References Cited

U.S. PATENT DOCUMENTS

| | | | |
|---|---|---|---|
| 3,684,862 | 8/1972 | Fischer et al. | 219/450 |
| 3,806,688 | 4/1974 | MacKenzie et al. | 219/625 |
| 4,128,768 | 12/1978 | Yamamoto et al. | 422/186.16 |
| 4,456,807 | 6/1984 | Ogino et al. | 219/626 |
| 4,638,135 | 1/1987 | Aoki | 219/627 |
| 4,757,176 | 7/1988 | Suzuki et al. | 219/626 |
| 4,876,689 | 10/1989 | Egawa | 372/38 |
| 5,136,277 | 8/1992 | Civanelli et al. | 340/568 |
| 5,283,727 | 2/1994 | Kheraluwala et al. | 363/98 |
| 5,424,512 | 6/1995 | Turetta et al. | 219/464 |
| 5,603,858 | 2/1997 | Wyatt et al. | 219/620 |
| 5,611,328 | 3/1997 | McDermott | 126/246 |
| 5,777,867 | 7/1998 | Hongu et al. | 363/134 |

FOREIGN PATENT DOCUMENTS 2 171 567 8/1986 United Kingdom .

*Primary Examiner*—Teresa Walberg
*Assistant Examiner*—Quang Van
*Attorney, Agent, or Firm*—Seidel, Gonda Lavorgna & Monaco

[57] ABSTRACT

The present invention relates generally to inductive heating, and more particularly to an apparatus and method for non-contact detection and inductive heating of heat retentive food server warming plates used in institutional food service. The invention provides a non-contact detection and control circuit for an inductive heating apparatus for heating an inductively reactive heat radiating element built into a warming plate. The warming plate employed by the invention has an integral inductively reactive heat radiating element that is brought to a desired heating temperature such as 450° F. In a preferred embodiment, the apparatus is configured like a conventional industrial cook stove and surface. Underneath the surface is a magnetic inductive coil controlled by the invention for inductively heating a reactive ferromagnetic heat radiating element that is placed on the surface.

14 Claims, 7 Drawing Sheets

| FIG. 2A | FIG. 2B |
|---|---|

APPARATUS AND METHOD FOR NON-CONTACT DETECTION AND INDUCTIVE HEATING OF HEAT RETENTIVE FOOD SERVER WARMING PLATES

FIELD OF THE INVENTION

The present invention relates generally to inductive heating, and more particularly to an apparatus and method for non-contact detection and control of inductive heating of heat retentive food server warming plates used in institutional food service.

BACKGROUND OF THE INVENTION

The invention is an inductive heating apparatus and method for heating an inductively reactive heat radiating element built into a heat retentive food server warming plate. Warming plates are also known in the industry as food service containers and are typically used in hospitals and restaurants for maintaining the appropriate serving temperature of prepared food.

Warming plates and devices for heating them are not unknown. For example, U.S. Pat. No. 3,684,862 discloses a thermostatically controlled electroresistive cooker hot plate having an temperature sensor for controlling the temperature of objects that are placed on the surface of the hot plate. The '862 patent does not disclose inductive heating, object detection by means of optical or inductive load sensing, foreign object discrimination, or temperature control by inductor current flow. In U.S. Pat. No. 4,757,176, an induction heating cooker control circuit is disclosed having a diode bridge rectifier, conditioning capacitors and inductors, a resonant heating coil circuit, a switching transistor and diode circuit, and oscillation circuitry for control and regulation of heat produced by an induction coil. The patent appears to provide for temperature sensing by means of a thermistor temperature sensor. However, unlike the present invention which is described below, the patent does not disclose the detection of an object by use of optical or inductive load sensing, foreign object discrimination, or temperature control by inductor current flow.

U.S. Pat. No. 5,136,277 discloses a cooking hob having a method and apparatus for detecting the presence and measuring the dimensions of an object on the surface of a glass ceramic hob. The patent discloses the control of halogen lamp heating elements on the basis of the measured dimensions of the detected object. In the '277 patent, an object is detected by a disturbance of an electric field that is generated by a conductive element that is separate and distinct from a heating element. However, unlike the preset invention, this patent does not disclose the incorporation of inductive load sensing or object discrimination by use of an induction coil and control circuitry.

In U.S. Pat. No. 5,424,512 a capacitive sensing device is disclosed for detecting the presence of a food cooking container on a cooking hob. The capacitive sensing device has a fixed capacitance that is established by two conductive plates of opposite polarities which are located under the surface of the hob. When a food container is placed on the surface, the fixed capacitance is changed, thereby causing the heating element, a resistive element or gas burner, to be activated according to parameters stored in a microprocessor. However, unlike the present invention, the patent does not disclose the detection of an object by use of optical or inductive load sensing, foreign object discrimination, or temperature control by inductor current flow.

U.S. Pat. No. 5,603,858 discloses a heat retentive server having a central heat storage member susceptible to electrical induction heating. Although the '858 patent describes a heat retentive server, it does not disclose in any detail a circuit or method for non-contact detection and inductive heating of heat retentive food server warming plates. In particular, this patent does not disclose object detection by means of optical or inductive load sensing, foreign object discrimination, or temperature control by inductor current flow.

U.K. patent application GB 2,171,567 discloses induction heating of electric plates of a cooker by applying high frequency power pulses greater than 20 kHz to an induction coil located under the surface of a cooker. Before power is applied to the induction coil, a ferromagnetic container or body must be placed onto the surface of the cooker. Detection of a ferromagnetic container is disclosed as the dynamic detection of the recovery time of the inductive energy within the induction coil. However, unlike the present invention, the patent does not disclose the detection of an object by use of optical, foreign object discrimination, or temperature control by inductor current flow.

The attempts made in the past to use induction heating to heat up hot plates for use in institutional food service are known to have many problems. One major problem with current systems is that a user can overheat a hot plate or initiate a heating cycle more than once and damage the hot plate. This present invention solves this problem by means of a novel control logic employing electronic signals such as a current feedback in a control loop of the induction heating unit to detect the difference between cold and heated plate. The electronic signals do not directly measure or detect the actual temperature of the plate being heated. Instead, the design relies upon the change in physical properties such as impedance and electrical resistance of the plate as it is heated to detect the difference in temperature between a cold and a heated plate. This design provides a more reliable turn-key go or no go system. For example, when a plate is cold it will be heated and a plate previously heated will not be heated.

The system allows the user to establish preselected heating parameters such as a current feedback value and sampling time for a hot plate or series of hot plates. In addition, the system may have pre-stored current feedback values and sampling times for any number of different hot plates and heat them at different rates and temperatures.

Although many attempts have been made in the prior art to produce a reliable and efficient system for heating warming plates for maintaining the serving temperature of food in the food service industry, none have solved the problem or addressed the need for an apparatus and method for non-contact detection and the control of inductive heating of heat retentive food server warming plates.

SUMMARY OF THE INVENTION

The invention is an inductive heating apparatus and method for detecting and inductively heating an inductively reactive heat radiating element built into a warming plate. The warming plate has an integral inductively reactive heat radiating element that is brought to a desired heating temperature such as 450° F. An example of warming plates intended for use with the present invention are more fully described in U.S. Pat. No. 5,611,328 which is incorporated herein by reference.

In a preferred embodiment, the apparatus is configured like a conventional industrial cook stove and surface. Underneath the surface is a magnetic inductive coil for inductively heating a reactive ferromagnetic heat radiating element that is placed on its surface.

The apparatus heats a plate having an inductively susceptible material. The apparatus is powered by a power source such as, but not limited to, three phase AC power source that is rectified into a single phase alternating current that is induced within the inductively susceptible material to produce heat according to $I^2R$. The apparatus may include an induction coil, a control circuit, and a detection circuit. The control has a diode rectifier circuit connected to a three phase AC power source and is used to rectify the alternating current into rectified direct current. A direct current filter is connected to the diode rectifier circuit for filtering the rectified direct current. A solid state device such as, but not limited to, an insulated gate bipolar transistor (IGBT) bridge is connected to the direct current filter and has at least one transistor switch for converting filtered direct current into a single phase alternating current at a preselected frequency.

The circuit includes a load matching circuit having a transformer for stepping up the single phase alternating current and for delivering the stepped up single phase alternating current to a load. The transformer is selected to provide an impedance match between the transistor switches and the load. The load is a resonant circuit which includes the induction coil, at least one capacitor for generating an alternating magnetic field, and the inductively susceptible material the serving plate.

In addition, the circuit may include a load detecting circuit having a detector such as, but not limited to, an LED for detecting the presence of a food server warming plate and an impedance detection circuit for detecting the presence of an inductively susceptible material.

In another embodiment, the present invention includes a plate support, an induction heating coil, control circuitry for sensing the inductive impedance of an object placed on the support and for increasing the frequency of alternating current supplied to the coil in proportion to the object's impedance, and detection circuitry for terminating induction heating if the rate of frequency increase indicates that the object does not have impedance characteristics of a warming plate of inductively susceptible material.

In one embodiment, the control circuit has a diode rectifier circuit connected to a three phase AC power source for rectifying alternating current into rectified direct current. A direct current filter is connected to the diode rectifier circuit for filtering the rectified direct current. An H bridge having commercially available solid state switches such as IGBT (Insulated Gate Bipolar Transistor) switches is connected to the direct current filter for converting filtered direct current into a single phase alternating current at a preselected frequency. IGBT switches such as those manufactured by Powerx, Inc. can be used.

A load matching circuit is connected to a load and the H bridge and includes a transformer for stepping up the single phase alternating current. The transformer delivers the stepped up single phase alternating current to a load, and is selected to provide an impedance match between the transistor switches and the load. The load is a resonant circuit including the induction coil, at least one capacitor for generating an alternating magnetic field, and the inductively susceptible material.

The apparatus includes a detecting circuit which includes a load detecting circuit having a detector such as an LED detector for detecting the presence of a food server warming plate. The detecting circuit may also include a load detection circuit such as an impedance detection circuit for detecting the presence of an inductively susceptible material.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Each warming plate employed by the present invention has an integral inductively reactive heat radiating element that is brought to a desired heating temperature such as 450° F. and will maintain food at a temperature of at least 140° F. for at least 1 hour.

Figure 1:
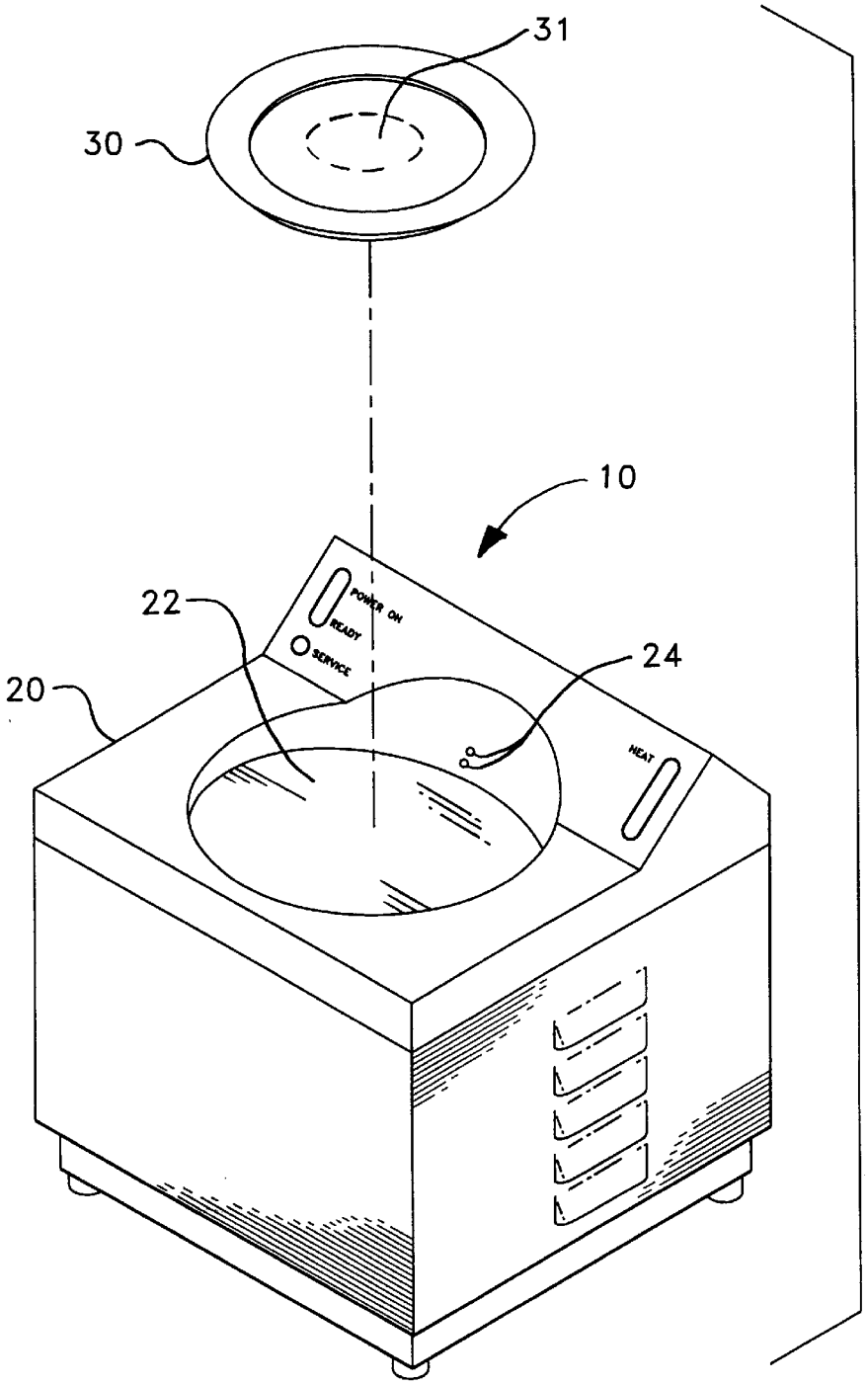
FIG. 1 is illustrates a non-contact induction heating apparatus according to the present invention.

Referring now to the drawings, wherein like numerals indicate like elements, there is shown in FIG. 1 an illustration of a non-contact induction heating apparatus 10 according to the present invention.

In a preferred embodiment, the apparatus 10 is configured like a conventional industrial cook stove 20 having a surface 22 for supporting a plate. Underneath the surface is a magnetic inductive coil (not shown) for inductively heating a reactive ferromagnetic heat radiating element 31 that is placed on the surface 22. Because the heat radiating element 31 is embedded into the warming plate 30 it never comes in physical contact with the surface of apparatus. The apparatus further includes a sensor 24 for detecting the presence of the warming plate 30.

Figures 2, 2A:
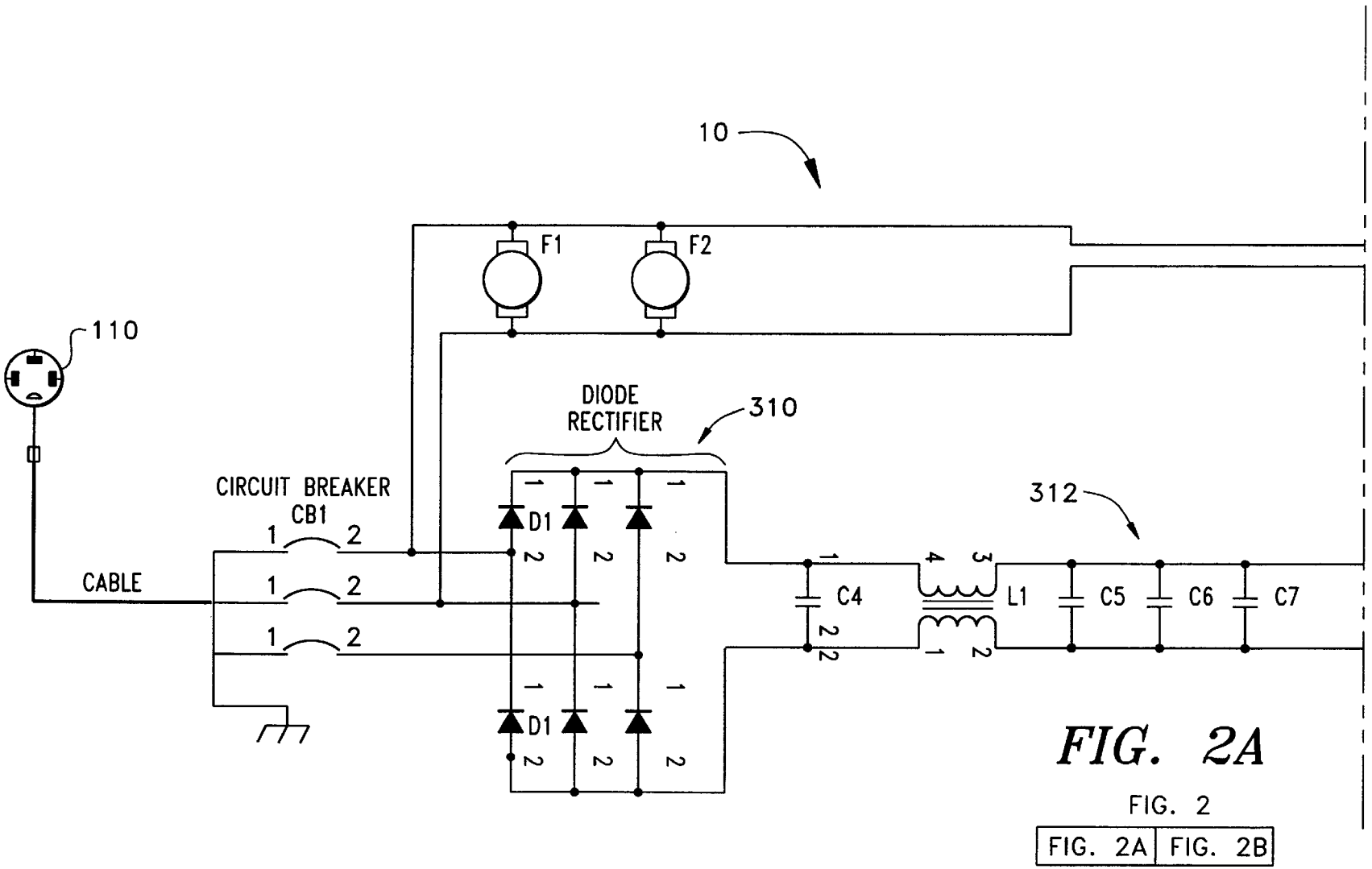
FIGS. 2A and 2B illustrates a circuit diagram for a non-contact induction heating apparatus according to the present invention.
Figure 2B:
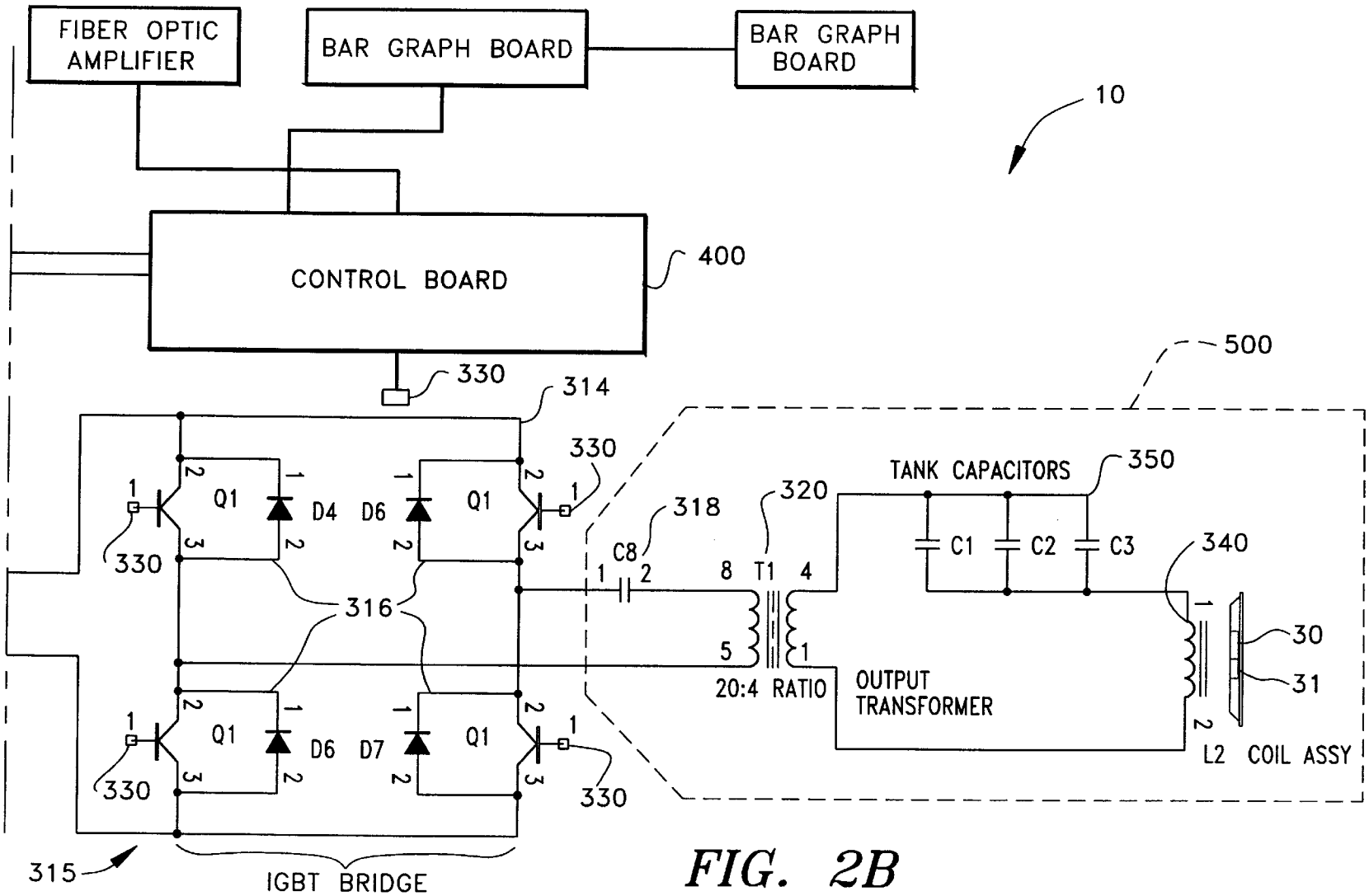

Referring to FIGS. 2A and 2B, a circuit diagram is shown for a non-contact induction heating apparatus 10 connected to a three phase alternating current (AC) power source 110 that is rectified by a diode rectifier circuit 310 into direct current (DC). The DC is filtered by a filter 312 and supplied to a conventional solid state device such as an insulated gate bipolar transistor (IGBT) 316. The IGBT devices 316 are used to form an H-bridge 314 (an IGBT bridge) and produce high frequency single phase AC which is delivered to a tuning capacitor 318 and an output transformer 320. The H bridge 314 has a transistor switching circuit 330 that causes the IGBT devices 316 to produce the high frequency single phase AC at an operating frequency specified by the control circuit 400. The frequency of the single phase AC is set by the control circuit 400 over a preferred frequency range between 16 and 20 kHz. However this range can be below 16 kHz and above 20 kHz depending upon the type of solid state device selected such as IGBT, MOSFET, BJT, or SCR. A matching circuit 500 is employed to match the impedance of the single phase AC source to a load by a step-up load matching transformer 320 for efficient power transfer from the transistor switching circuit 314.

The load is a resonant circuit comprising an inductive load coil 340, a capacitor bank 350, and an inductively reactive heat radiating element 31 built into the warming plate 30. The load coil 340 and capacitor bank 350 of the resonant circuit create an alternating magnetic field which induces an alternating current within the reactive heat radiating element 31. Because the heat radiating element 31 is an inductively susceptible material such as a ferromagnetic steel disk it produces heat according to the known relationship of $P=I^2R$, where P represents the amount power in the form of heat produced by the induced current, I, and resistance, R, of the ferromagnetic steel disk.

Figure 3:
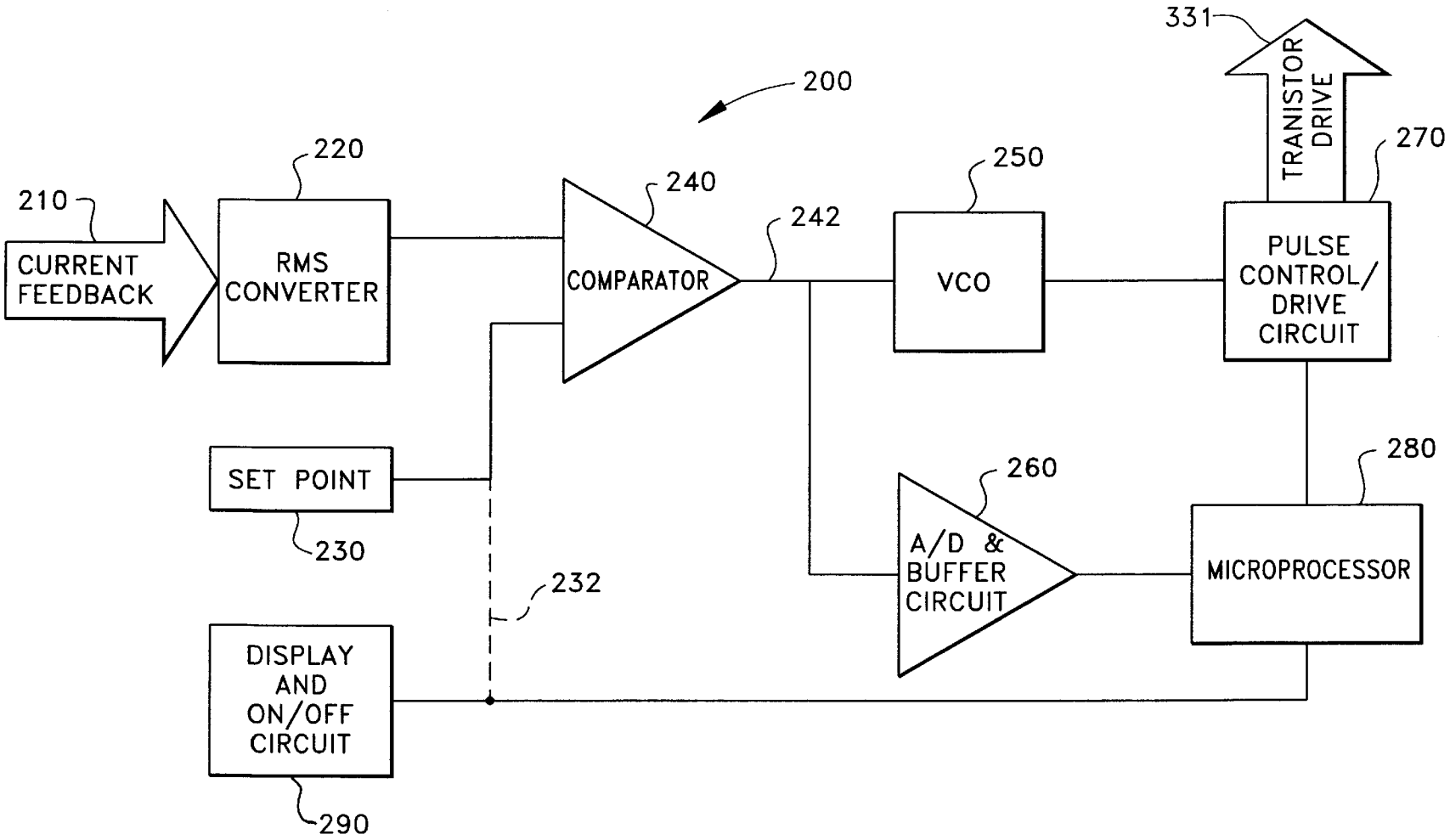
FIG. 3 illustrates a functional block diagram of a control circuit for induction heating apparatus according to the present invention.

Referring to FIG. 3, a functional block diagram of a non-contact induction heating apparatus is shown according to the present invention. The amount of heat produced in the warming plate 30 is determined by control logic 200 which determines a heating cycle. The heating cycle is defined by the time duration and operating frequency of the high frequency AC current that is applied to the warming plate 30.

In a preferred mode, the duration of the heating cycle for a selected heating plate is fixed at about 10 seconds and the current going to the coil is produced at a frequency selected from a range between 16 to 20 kHz. However, this values of the heating cycle time and AC frequency can have other values which are selected to accommodate parameters related to the type and size of plate, solid state device, and temperature desired.

As the load approaches a resonant frequency defined by the load coil and capacitor bank the single phase AC and resultant heat induced in the plate 30 will increase. As the frequency of the single phase AC diverges from the resonant frequency of the load coil and capacitor bank, the AC and resultant heat in the reactive heat radiating element will decrease. The control circuit monitors the high frequency AC current delivered to the load to control the total power delivered to the load and resulting temperature of the warming plate.

In FIG. 3, when a plate is loaded on the surface 22 of the apparatus 10, a microprocessor 280 receives a signal from a sensor 24 such as an optical sensor or an LED. The microprocessor 280 checks for faults, if none are detected, the microprocessor 280 enables the control circuit 200 to heat the warming plate 30.

A portion of the single phase AC 210 is fed back to the control circuit 200 where it is buffered and converted by an RMS convertor 220 to a true root means square (RMS) DC current level. The feedback current 210 is then compared to a current set point 230 by a comparator 240. The output of the comparator 240 is fed to a voltage controlled oscillator (VCO) 250 which drives frequency control and gate drive circuitry 270 controlling the transistors 314 of the transistor switching circuit 330. A portion of the output of the comparator 240 is also fed to an analog-to-digital (A/D) convertor and buffer circuit for use by the microprocessor 260 in the heating cycle.

If the feedback current 210 is below the set point 230, the VCO 250 raises its operating frequency which raises the frequency of the single phase AC until the feedback current 210 reaches the set point 230. As an option, the set point can be changed by the microprocessor 280 by an optional connection 232. Thereafter, the operating frequency of the single phase AC is lowered to maintain the desired AC current delivered to the load 30. If the feedback current 210 rises above the set point 230, the VCO 250 lowers its frequency which lowers the frequency of the AC current to the load 30. The circuit continually regulates the frequency of the AC current and therefore the heat cycle of the apparatus.

Figure 4:
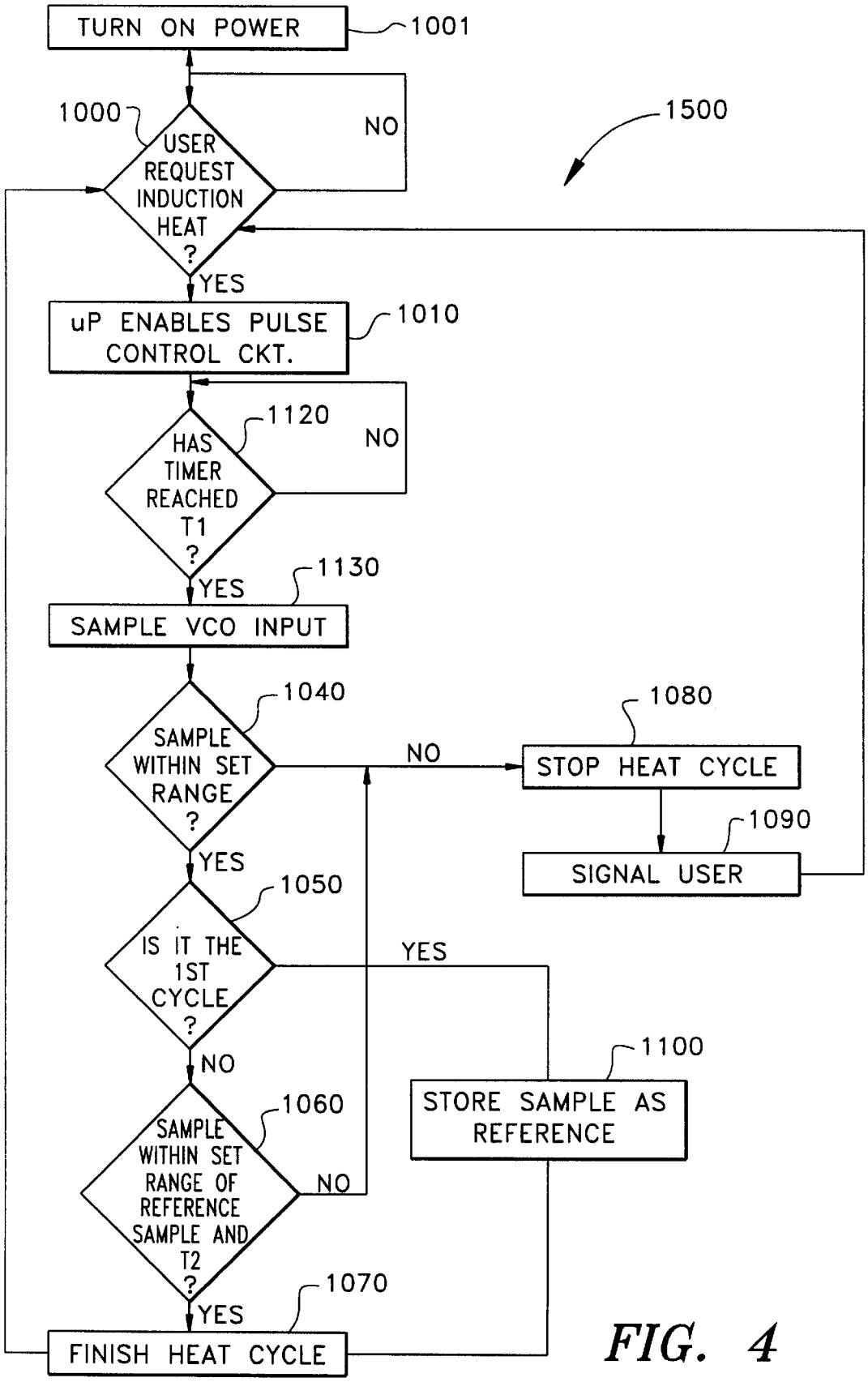
FIG. 4 illustrates a flow chart of a method for non-contact induction heating according to the present invention.

Referring to FIG. 4 which illustrates a flow chart of a method for non-contact induction heating according to the present invention, if a plate is loaded on the power supply a "heat request" 100 signal is sent to the microprocessor 280. The microprocessor 280 enables the gate drive circuit 200 which begins the current regulation process described above. At time T1, about 500 ms, as a determined by a timer 1010, the feedback control loop should have enough time to settle in and regulate the current in the coil 340. At this time a request is sent to the A/D (analog to digital converter) which reads 1130 the value of the VCO input voltage. This voltage can be scaled to a value equal to the frequency of the current in the coil 340.

The method compares the VCO input to preselected values 1040 stored in the microprocessor as established in its program. If the sample falls outside the predefined limit 1060, the microprocessor 280 stops 1080 the apparatus and signals 1090 the user. By this method the invention determines if the object on the induction heating unit is the correct object or a false one. The correct object requires the unit to run at a specific frequency to achieve the desired coil current, in another object this frequency will be different.

If this is the first cycle 1050 and main power was turned on 1001, the sample VCO input is saved 1110. On consecutive plates, this value is compared 1060 to the previously saved value 1110. If the value is within a preselected range such as 20 percent or +/−10 percent of the previous value, the cycle is competed 1070 and the sampled valued is stored 1110 replacing the previous sample. The device is now ready to heat another heating plate 30.

If the sample is outside 1040, say a range of +/−10%, the microprocessor stops the unit 1080 and signals the user 1090. This is how the invention determines that a plate has already been heated. A cold plate requires a certain frequency to operate at the desired coil current. As the plate heats the frequency of the single phase AC will drop. By comparing the VCO sample from the previous plate which is cold when sampled to the value of the next plate, we can determine if the next plate is hot and reject it. The adaptive nature of storing the previous sample allows the elimination of errors from outside influences such a AC line power fluctuations, room temperature variations, or wet plates.

The unit is allowed to continue until it has reached T2, about 10 seconds 1060 which is a time out. When the T2 is reached the microprocessor then stops the gate drive 330 which stops power from flowing to the coil 340, finishes the heat cycle 1070, and notifies the user to remove the plate 30. The microprocessor then waits for the next plate to be loaded before repeating a heating cycle.

In operation, the apparatus will reach the desired current within the first 300 ms of the heating cycle, and regulate the current at the set point. After 500 ms the microprocessor will sample the input voltage to the VCO and compare it to the set point. If the input voltage is outside the programmed range, the microprocessor disables the frequency control circuit and sends a fault signal to the user indicating a foreign object. The apparatus can be programmed to store and accept the reactive characteristics of the foreign object as the desired object to be heated. Thereafter, the apparatus will reject and not heat any object having the characteristics different than that stored by the apparatus. The microprocessor allows the apparatus to store any number of reactive characteristics allowing it to selectively heat or reject an equal number of objects.

If the object is recognized by the apparatus the induction process continues until the user stops the cycle or at the conclusion of the heat cycle. At the end of the cycle, the microprocessor will cause an indication to the user that the cycle is complete. Once the plate is removed, the microprocessor resets until another plate is placed on its surface. The cycle is repeated for each plate placed onto the surface of the apparatus.

In one embodiment of the present invention where no preset values are used the system will sample the first hot plate, store its value establishing a set point and proceeds to compare and heat subsequent hot plates of similar physical characteristics. For example, the induction heating unit heats the first plate until the current feedback from the control loop reaches a default or preselected value stored by the invention or as determined by intervention from the user. The feedback value is then stored and thereafter used by the invention until a new value is selected or determined by intervention from the user.

After the initial cycle, the invention is ready to receive subsequent plates. When a new plate is detected, the control system applies power to an induction coil and samples the VCO input voltage from within a control loop and compares its value to a set point. If the value is within a preselected range such as, but not limited between 2 and 4.5 volts, when sampled within 500 ms, the heating cycle will continue until the plate reaches the desired temperature. If the value of the VCO input voltage from a plate falls outside the preselected range, the plate will be rejected and the heating cycle will be discontinued for that plate. The out-of-range sample values of the out-of-range hot plate will not be stored, however, the system will continue to sample and heat those plates having characteristics similar to that stored from the first plate sampled. The system can be reset by the user or upon power up.

This process also solves another significant problem associated with current hot plate heating systems, that is, the heating of an object other than the desired hot plate. The present invention solves this problem by using the current feedback from the control loop again when it detects the difference between a desired plate to be heated and a "foreign object." The term "foreign object" is any object having physical characteristics that fails to produce the appropriate current feedback from the control loop within the sampling circuit and control logic of the invention.

In a preferred embodiment of the invention, the warming plate as described in U.S. Pat. No. 5,611,328 can be in the shape of a standard ceramic serving plate. Within the plate is embedded a disk of inductively reactive ferromagnetic steel weighing about 0.9 lbs. During the heating cycle, the disk is heated to about 450° F. in about 10 seconds. The composition of the ferromagnetic material and encapsulating plate material are selected for structural and thermal stability to allow the plate edges to be handled after being heated. The warming plate incorporating the inductive heating disc is placed on the surface of the apparatus and heated by the inductive coil according to parameters established by the operation of the control circuit.

An important feature of the invention is that it prevents inadvertent and unwanted heating of objects other than the warming plate that may be placed on the surface of the apparatus. The apparatus senses for the presence of the inductive heating disk of the warming plate before the inductive load coil can be energized. Only objects that are reactive over the frequencies of operation of the apparatus can trigger the apparatus to energize the inductive load coil. Accordingly, the frequency of operation of the apparatus is selected to be in a range outside that of ordinary objects commonly found in food service such as cooking utensils, pots, pans, etc.

Figure 5:
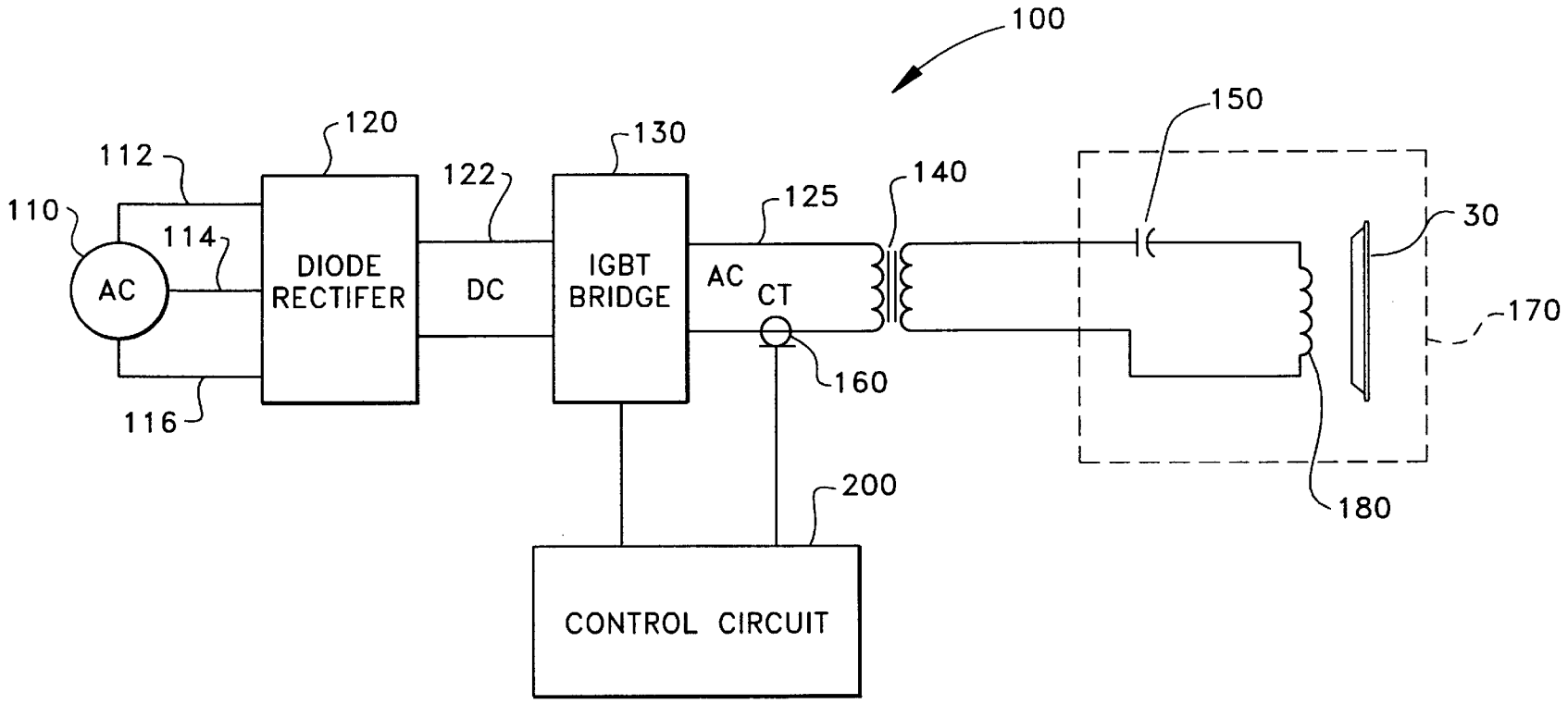
FIG. 5 illustrates a functional block diagram of the present invention.

FIG. 5 illustrates a functional block diagram of the present invention. In FIG. 5, a 3 phase AC power 110 is converted to DC power 122 by a rectifier 120. A transistor switch 130 converts the DC power 122 to a single phase AC power 125 running at the frequency specified by the control circuitry 200. In a preferred embodiment this is in a range from 16 to 20 kHz. The AC power is stepped up by a load matching transformer 140 which enables the most efficient match between the transistors and the hot plate.

Figure 6:
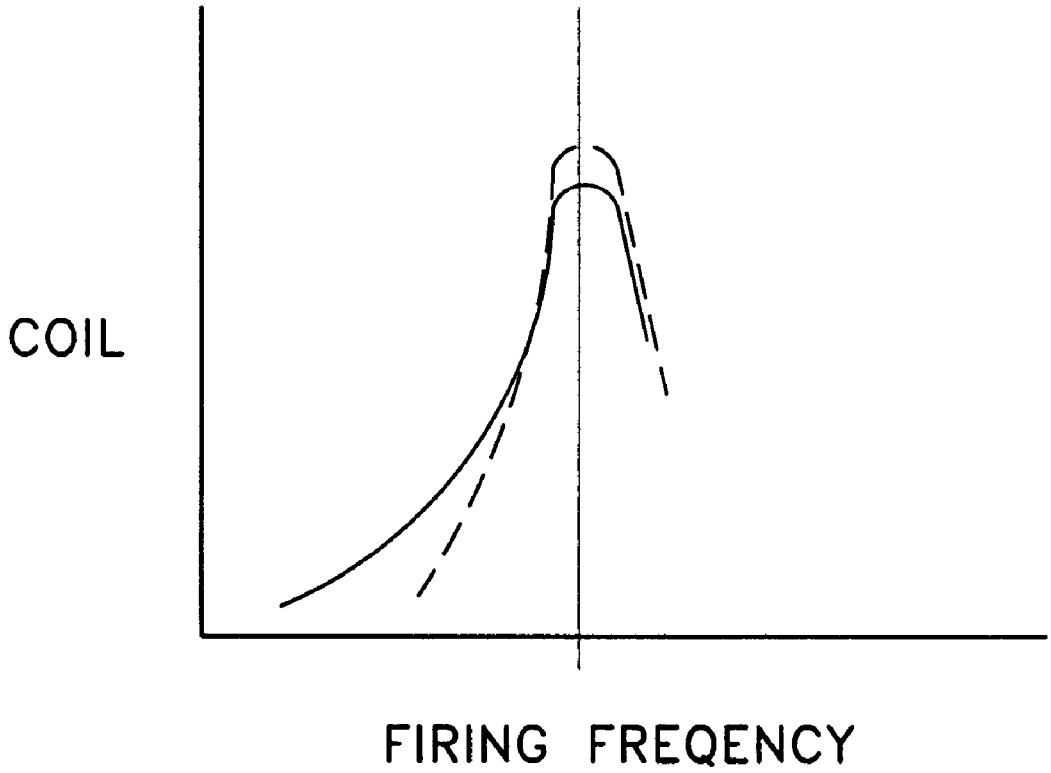
FIG. 6 illustrates the performance of a resonant power control according to the present invention.

A resonant circuit 200 consisting of the load coil 180 and a capacitor bank 150 create an alternating magnetic field which induces an alternating current into a heating plate 30. The plate having a resistive loss in the presence of induced current according to $I^2R$ will produce heat. The amount of heat in the hot plate 30 is controlled by the time of the heating cycle and the amount of current flowing to the coil. At a predetermined time such as 10 15 seconds the current going to the coil is controlled by varying the operating frequency of the transistors and has a characteristic as shown in FIG. 6. As the frequency of the single source AC approaches the resonant frequency of the load coil 180 and capacitor bank 150 the current increases. As the frequency is lowered from the resonant frequency the current is decreased. A current feed back circuit 160 monitors the primary current delivered to the transformer 140 which is then fed back to the control circuit 200 to control the power going to the hot plate 30.

In a preferred embodiment, a non-contact detection and control circuit for an induction heating unit includes an optical sensing circuit for sensing a hot plate 30 loaded on a heating surface 24 of the apparatus 10 and producing a signal when a hot plate is sensed. A microprocessor 280 connected to the optical sensor 24 receives the signal produced by the optical sensing circuit which allows the control circuit 200 to heat the hot plate 30 when it is sensed. A current to voltage converter 220 is connected to a single phase alternating current source 315 having a frequency controlled by a transistor switching circuit 330. A portion of the current from the single phase alternating current source 315 is used as a feedback current signal 210 in the control circuit 200. The feedback current signal 210 is buffered and converted by a convertor 220 into a true root means square (RMS) DC current level.

A comparator 240 is connected to the current-to-voltage converter 220 and compares the feedback current signal 220 to a current set point 230 in order to produce a voltage control signal 242. A voltage controlled oscillator (VCO) 250 is connected to the comparator 240 and a frequency (also known as a pulse) control drive circuit 330. The VCO 250 receives the voltage control signal 242 from the comparator 240 and drives the output 331 of the frequency control drive circuit 270. The frequency control drive circuit 270 is connected to gate drive circuitry 330 of the transistor switching circuit 314 of the single phase alternating current source 315 and continuously regulates its output.

In another embodiment, the apparatus includes a frequency variable single phase alternating current source 315 for inducing a single phase alternating current within an inductively susceptible material 31 to produce heat according to $I^2R$. A control circuit 200 having a detection circuit that includes a sensor 24 and/or the detection logic scheme described above is employed. The control circuit is connected to the alternating current source 315 at a point 160 for detecting the presence of the food server warming plate 30. The control circuit 200 controls the frequency of the variable single phase alternating current source 315 and the current induced in the food server warming plate 30.

The control circuit 200 controls the current in the load coil 180 by regulating the single phase alternating current source 315. The single phase alternating current source is a an IGBT H bridge 314 which supplies single phase alternating current 315 to a primary winding of an impedance matching transformer coil 320. A secondary winding of the transformer coil 320 is attached to an induction load coil 340 and induces the single phase alternating current in the food server warming plate 30.

The control circuit 200 includes a convertor 220 which is connected to the alternating current source for converting a portion 210 of the current supplied to the load coil 340 into an RMS voltage. The converter 220 converts 0.0 current at frequency of 16 kHz to 0.0 volts and full current at a frequency of 20 kHz to 10 volts. A comparator 240 is connected to the convertor 220 for comparing the converted RMS voltage from the converter 220 to a set point voltage 230. The comparator 240 providing an output proportional to the difference between the converted RMS voltage and the set voltage 230. In one aspect of the invention, the comparator 240 is an error amp circuit which provides an output proportional to the error between the converted RMS voltage and the set voltage.

The control circuit 200 includes a VCO 250 connected to the comparator output 240 and the IGBT H bridge 314. The VCO 250 has an output connected to a gate drive circuit 270 that controls the frequency of the current produced by the IGBT H bridge 514. The comparator output 242 drives the VCO 250 which drives the transistor switches 316. In one aspect of the invention, the voltage output of the VCO is 0.0 at a frequency about 16kHz and 15 volts at a frequency of 20 kHz.

The control circuit 200 further includes a microprocessor 280 which receives and sends signals to and from the control circuit 200 and a detection circuit which can include the sensor 24 and a circuit or program having performing a logic function 1500 described in the flow chart of FIG. 4 showing a method for non-contact induction heating according to the present invention.

In one aspect of the invention, the microprocessor provides a set point to the comparator. In another aspect of the invention, the detection circuit sends a "heat request" signal to a microprocessor when a plate is loaded on the apparatus, and the microprocessor 280 enables the gate drive circuit 270 which controls current regulation of the alternating current supply. The microprocessor 280, after a preselected time such as, but not limited to, 500 ms allows the feedback current to settle to a preselected value and regulates the induction coil current by sensing the value of the VCO input voltage 242. When the preselected time T1 is 500 ms the VCO input voltage can has a preferred range of 0 to 15 volts. However it is understood that this range can be varied according to need.

The microprocessor 280 compares the VCO input value 242 to preselected VCO values stored in the microprocessor 280 and stops the current supply when the VCO input 242 exceeds the preselected VCO values. Preselected VCO values preferably include i) an initial VCO input range of 2 to 4.5 volts, and ii) a subsequent VCO input range that is established after the first warming plate is heated. The subsequent VCO input range, as described above, can be within about 20 percent of the VCO input voltage produced when heating the previous warming plate. The VCO input voltage can be that produced when heating the previous warming plate, or any value stored in the microprocessor. In one aspect of the invention, the detecting circuit further comprises an impedance detection circuit which uses the VCO input voltage as described for detecting the presence of an inductively susceptible material.

In another embodiment of the invention, an apparatus for inductive heating of warming plates which includes a plate support 22, an induction heating coil 340 and control circuitry 200 for sensing the inductive impedance of an object 30 placed on the support 22. The control circuit increasing the frequency of alternating current supplied to the coil 340 in proportion to the object's inherent characteristics such as, but not limited to impedance, magnetic coupling factors, or material composition.

The apparatus includes detection circuitry for terminating induction heating if the rate of frequency increase indicates that the object does not have impedance characteristics of a warming plate of inductively susceptible material. The inductively susceptible material have characteristics known and stored in the microprocessor or determined by the apparatus on the first heating cycle.

In one aspect of the invention, the current delivered to the load is controlled by varying the operating frequency of the transistor switches in a range from 0 to 100 kHz. In another aspect of the invention, the current delivered to the load is controlled by an operating frequency of the transistor switches above 100 kHz. In another aspect of the invention, the current delivered to the load increases as the frequency of the single phase alternating current approaches the resonant frequency of the induction coil and at least one capacitor. The current delivered to the load decreases as the frequency of the single phase alternating current diverges from the resonant frequency of the induction coil and at least one capacitor.

The apparatus further includes regulation circuit 200 connected to and for regulating the single phase alternating current delivered to the load coil 340 and matching transformer 320. the regulation circuit 200 regulating the single phase current flowing through the load coil, the monitoring circuit forming a feed back loop 210 between the inverter circuit and the single phase alternating current delivered to the load.

The invention further includes an error amplifier 240 for comparing the current produced in the feed back loop with the set point 230. The error amplifier 240 providing a varying signal to the VCO 250 to control frequency which in turn controls the current delivered to the load. In one aspect of the invention the predetermined time is less than or equal to 500 ms.

In another aspect, the predetermined time is greater than 500 ms.

The present invention may be embodied in other specific forms without departing from the spirit or essential attributes thereof and, accordingly, reference should be made to the appended claims, rather than to the foregoing specification, as indicating the scope of the invention.

What is claimed is:

1. An apparatus for non-contact detection and inductive heating of heat retentive food server warming plates having an inductively susceptible material, the apparatus being powered by a three phase AC power source for inducing a single phase alternating current within the inductively susceptible material to produce heat according to $I^2R$, the apparatus comprising:

an induction coil, and a detection and control circuit having, a diode rectifier circuit connected to the three phase AC power source for rectifying alternating current into rectified direct current, a direct current filter connected to the diode rectifier circuit for filtering the rectified direct current, an H bridge connected to the direct current filter and having IGBT (Insulated Gate Bipolar Transistor) switches for converting filtered direct current into a single phase alternating current at a preselected frequency, and a load matching circuit connected to a load and the H bridge single phase alternating current and for delivering the stepped up single phase alternating current to the load, the transformer being selected to provide an impedance match between the transistor switches and the load, and a load detecting circuit having an LED detector for detecting the presence of a food server warming plate and an impedance detection circuit for detecting the presence of an inductively susceptible material, wherein the load is a resonant circuit including the induction coil, at least one capacitor for generating an alternating magnetic field, and the inductively susceptible material.

2. An apparatus according to claim 1 wherein the single phase alternating current has a preselected frequency about a range from 16 to 20 kHz.

3. An apparatus according to claim 1 wherein the inductively susceptible material is a steel disk and the amount of heat produced in the steel disk is controlled by the time of the heating cycle and the amount of current flowing in the induction coil.

4. An apparatus according to claim 3 wherein the time of the heating cycle is fixed at about 10 seconds.

5. An apparatus according to claim 1 wherein the current delivered to the load is controlled by varying the operating frequency of the transistor switches in a range from 16 to 20 kHz.

6. An apparatus according to claim 1 wherein the current delivered to the load is controlled by varying the operating frequency of the transistor switches in a range from 0 to 100 kHz.

7. An apparatus according to claim 1 wherein the current delivered to the load is controlled by an operating frequency of the transistor switches above 100 kHz.

8. An apparatus according to claim 1 wherein the current delivered to the load increases as the frequency of the single phase alternating current approaches the resonant frequency of the induction coil and at least one capacitor, and the current delivered to the load decreases as the frequency of the single phase alternating current diverges from the resonant frequency of the induction coil and at least one capacitor.

9. An apparatus according to claim 1 wherein the control circuit further comprises a regulation circuit connected to and for regulating the single phase alternating current delivered to the load matching transformer and regulating the single phase current flowing through the load coil, the control circuit forming a feed back loop between the inverter circuit and the single phase alternating current delivered to the load.

10. An apparatus according to claim 9 wherein the control circuit further comprises an error comparator for comparing a feedback current produced in the feed back loop with a set point, the error comparator providing a varying signal to the VCO to control frequency which in turn controls the single phase alternating current delivered to the load.

11. An apparatus according to claim 10 wherein the error comparator samples the feedback current beginning at a predetermined time after initiation of a heat cycle.

12. An apparatus according to claim 10 wherein the predetermined time is about 500 ms.

13. A method for non-contact detection and inductive heating of heat retentive food server warming plates having an inductively susceptible material, the apparatus being powered by a three phase AC power source for inducing a single phase alternating current within the inductively susceptible material to produce heat according to $I^2R$, the method comprising the steps of:

inducing a single phase alternating current within the inductively susceptible material by means of an induction coil, and detecting the inductively susceptible material and controlling the single phase alternating current by means of a detection and control circuit having, a diode rectifier circuit connected to the three phase AC power source for rectifying alternating current into rectified direct current, a direct current filter connected to the diode rectifier circuit for filtering the rectified direct current, an H bridge connected to the direct current filter and having IGBT (Insulated Gate Bipolar Transistor) switches for converting filtered direct current into a single phase alternating current at a preselected frequency, a load matching circuit connected a load and the H bridge and having a transformer for stepping up the single phase alternating current and for delivering the stepped up single phase alternating current to a load, the transformer being selected to provide an impedance match between the transistor switches and the load, and a load detecting circuit having an LED detector for detecting the presence of a food server warming plate and an impedance detection circuit for detecting the presence of an inductively susceptible material, wherein the load is a resonant circuit including the induction coil, at least one capacitor for generating an alternating magnetic field, and the inductively susceptible material.

14. A non-contact detection and control circuit for an induction heating unit, the circuit comprising:

a diode rectifier circuit connected to a three phase AC power source for rectifying alternating current into rectified direct current, a direct current filter connected to the diode rectifier circuit for filtering the rectified direct current, an H bridge connected to the direct current filter and having IGBT (Insulated Gate Bipolar Transistor) switches for converting filtered direct current into a single phase alternating current at a preselected frequency, a load matching circuit connected a load and the H bridge and having a transformer for stepping up the single phase alternating current and for delivering the stepped up single phase alternating current to a load, the transformer being selected to provide an impedance match between the transistor switches and the load, and a load detecting circuit having an LED detector for detecting the presence of a food server warming plate and an impedance detection circuit for detecting the presence of an inductively susceptible material, wherein the load is a resonant circuit including an induction coil, at least one capacitor for generating an alternating magnetic field, and the inductively susceptible material.

* * * * *